US011044562B1

(12) United States Patent
Cho et al.

(10) Patent No.: US 11,044,562 B1
(45) Date of Patent: Jun. 22, 2021

(54) MULTI-DIAPHRAGM SPEAKER DRIVEN BY MULTIPLE VOICE COIL PLATES AND A SHARED PERMANENT MAGNET PAIR

(71) Applicant: Resonado, Inc., South Bend, IN (US)

(72) Inventors: Leeg Hyun Cho, Yongin-si (KR); Youngil Cho, Chicago, IL (US); Darrell Seyler Adams, Dripping Springs, TX (US)

(73) Assignee: Resonado, Inc., South Bend, IN (US)

( * ) Notice: Subject to any disclaimer, the term of this patent is extended or adjusted under 35 U.S.C. 154(b) by 0 days.

(21) Appl. No.: 15/930,341

(22) Filed: May 12, 2020

Related U.S. Application Data

(60) Provisional application No. 62/964,042, filed on Jan. 21, 2020.

(51) Int. Cl.
*H04R 7/16* (2006.01)
*H04R 9/06* (2006.01)
*H04R 9/02* (2006.01)

(52) U.S. Cl.
CPC ..... *H04R 7/16* (2013.01); *H04R 9/025* (2013.01); *H04R 9/06* (2013.01)

(58) Field of Classification Search
CPC . H04R 7/16; H04R 9/025; H04R 9/06; H04R 1/44; H04R 1/06; H04R 1/323; H04R 1/345; H04R 9/02; H04R 9/063; H04R 2209/041; H04R 2499/11; H04R 2400/03
USPC ..... 381/398, 396, 192–195, 400–402, 404, 381/407, 420, 199
See application file for complete search history.

(56) References Cited

U.S. PATENT DOCUMENTS

| | | | | |
|---|---|---|---|---|
| 7,480,392 | B2 | 1/2009 | Shin et al. | |
| 7,502,486 | B2 | 3/2009 | Shin et al. | |
| 9,191,747 | B2 | 11/2015 | Dodd | |
| 2004/0008859 | A1* | 1/2004 | Zhao | H04R 9/063 381/401 |
| 2004/0071303 | A1* | 4/2004 | Furuya | H04R 9/063 381/182 |
| 2006/0002579 | A1* | 1/2006 | Watanabe | H04R 7/12 381/403 |
| 2008/0044044 | A1* | 2/2008 | Madaffari | H04R 9/025 381/186 |
| 2009/0080686 | A1* | 3/2009 | Funahashi | H04R 9/043 381/398 |
| 2011/0044489 | A1 | 2/2011 | Saiki et al. | |
| 2014/0105445 | A1 | 4/2014 | Kim | |
| 2014/0161303 | A1 | 6/2014 | Kim | |

(Continued)

FOREIGN PATENT DOCUMENTS

| | | |
|---|---|---|
| CN | 106792394 A | 5/2017 |
| KR | 101425912 B1 | 8/2014 |

(Continued)

*Primary Examiner* — Alexander Krzystan
*Assistant Examiner* — Julie X Dang
(74) *Attorney, Agent, or Firm* — DLA Piper LLP (US)

(57) ABSTRACT

Embodiments are disclosed of a speaker containing multiple diaphragms and multiple voice coils. Each diaphragm is driven by its own voice coil plate, and at least two of the voice coil plates share at least one or more parts of a permanent magnet pair. In some embodiments, the speaker generates bi-directional sound. Optionally, the multiple diaphragms are of varying sizes, such that the diaphragms are configured to transmit different frequency ranges.

8 Claims, 13 Drawing Sheets

(56) References Cited

U.S. PATENT DOCUMENTS

| | | | | |
|---|---|---|---|---|
| 2014/0219494 | A1 | 8/2014 | Kim | |
| 2015/0139479 | A1* | 5/2015 | Lai | H04R 9/025<br>381/412 |
| 2016/0205479 | A1 | 7/2016 | Tomar et al. | |
| 2016/0373862 | A1 | 12/2016 | Yoon et al. | |
| 2020/0275190 | A1 | 8/2020 | Cho | |

FOREIGN PATENT DOCUMENTS

| | | | |
|---|---|---|---|
| KR | 20170112611 | A | 10/2017 |
| WO | 2018 096761 | A1 | 5/2018 |

* cited by examiner

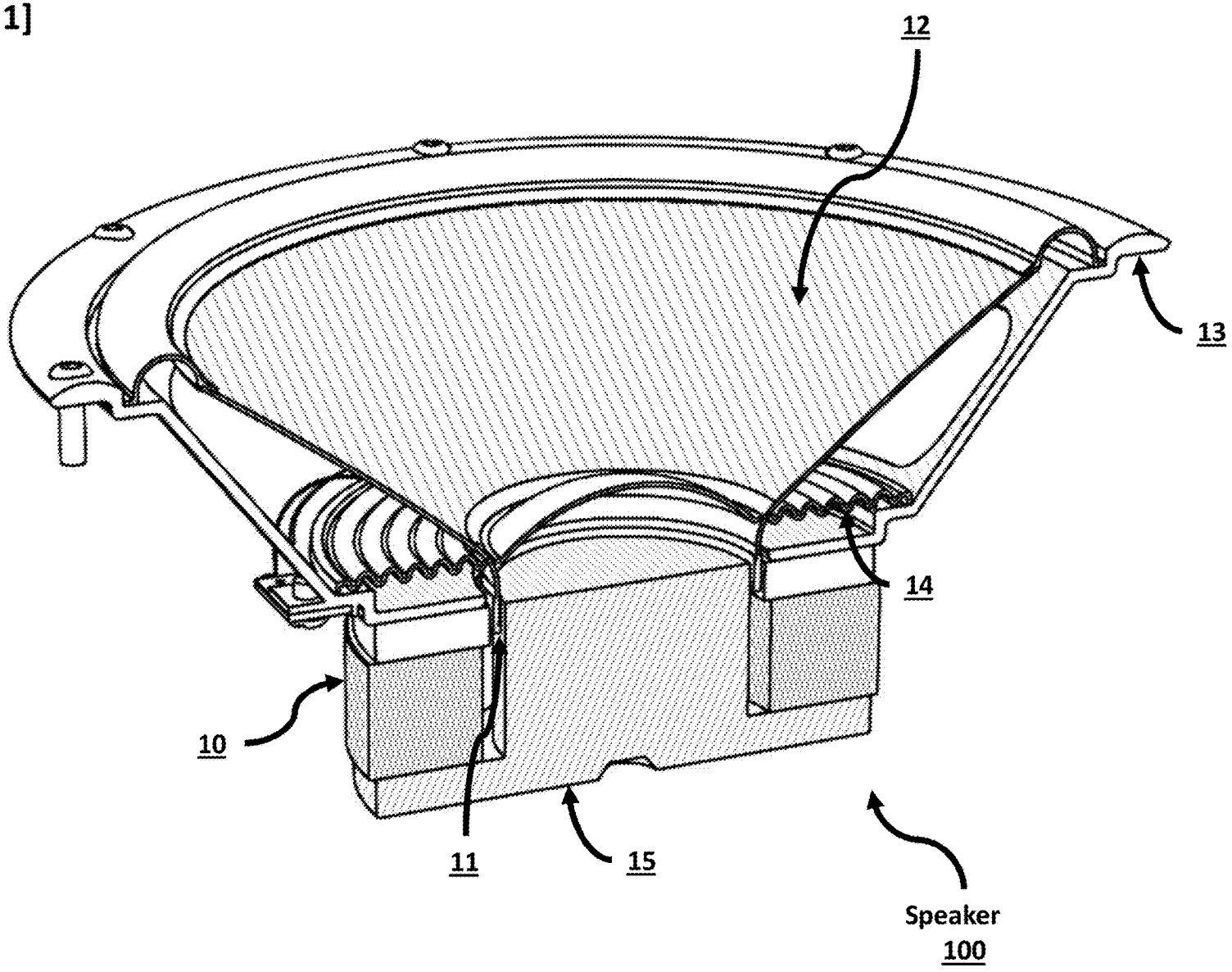
[Fig. 1]

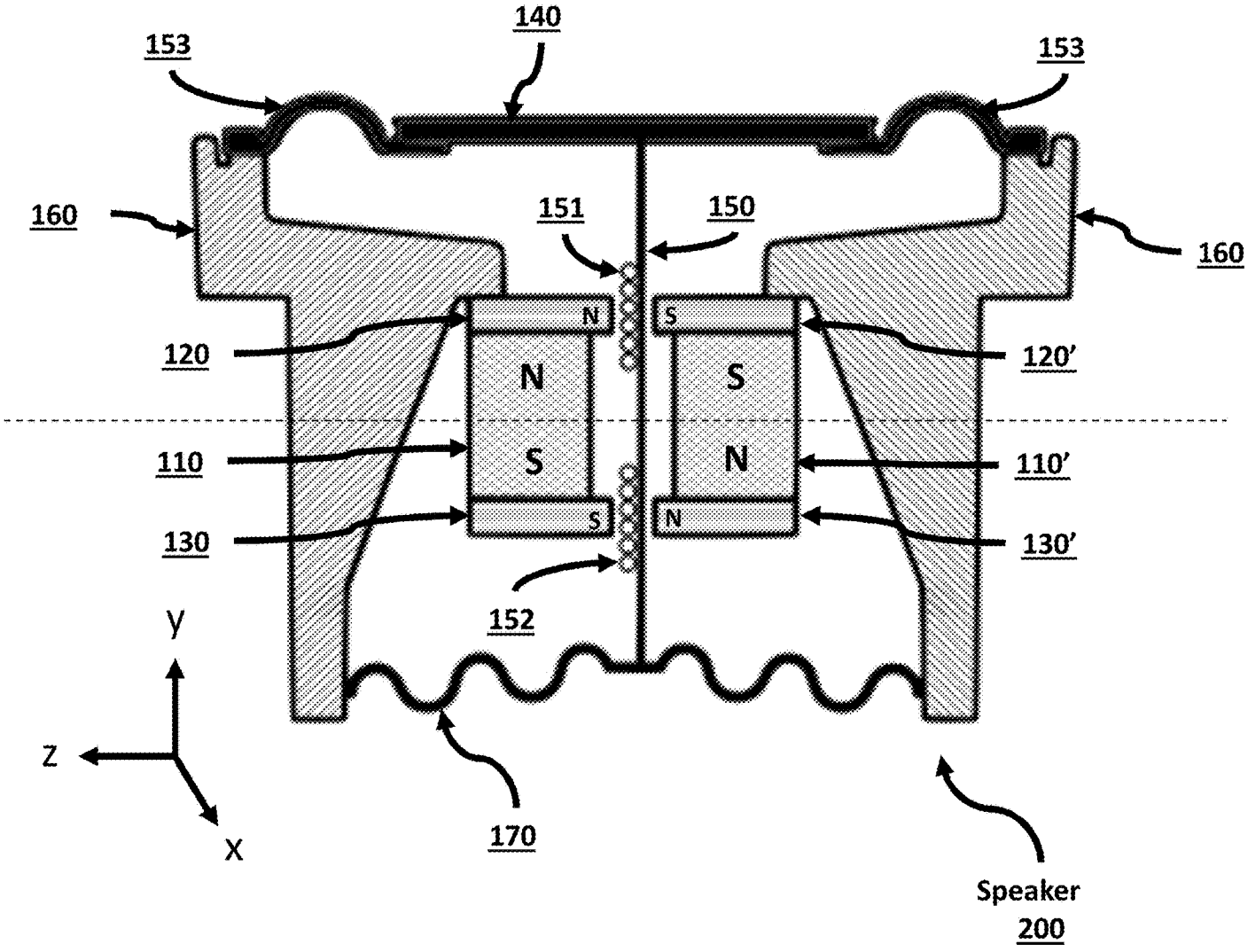
[Fig. 2]

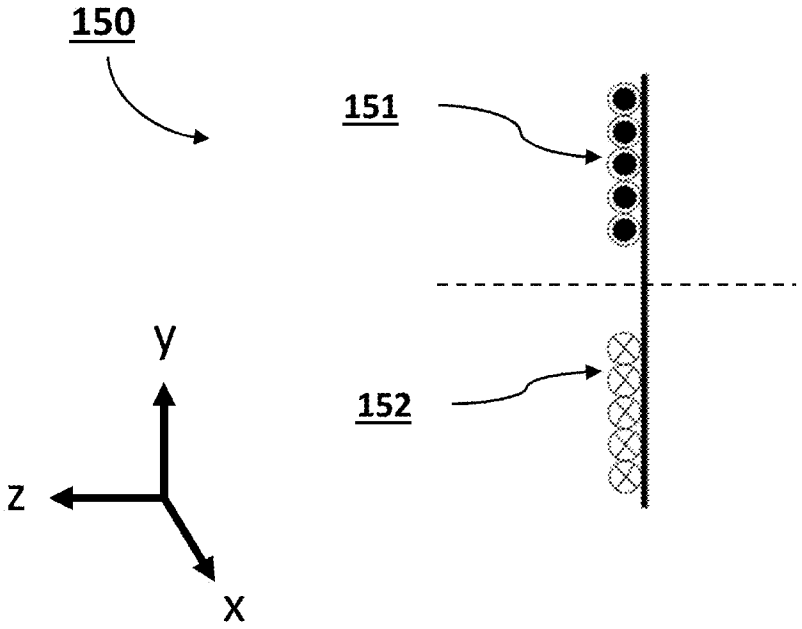
[Fig. 3A]

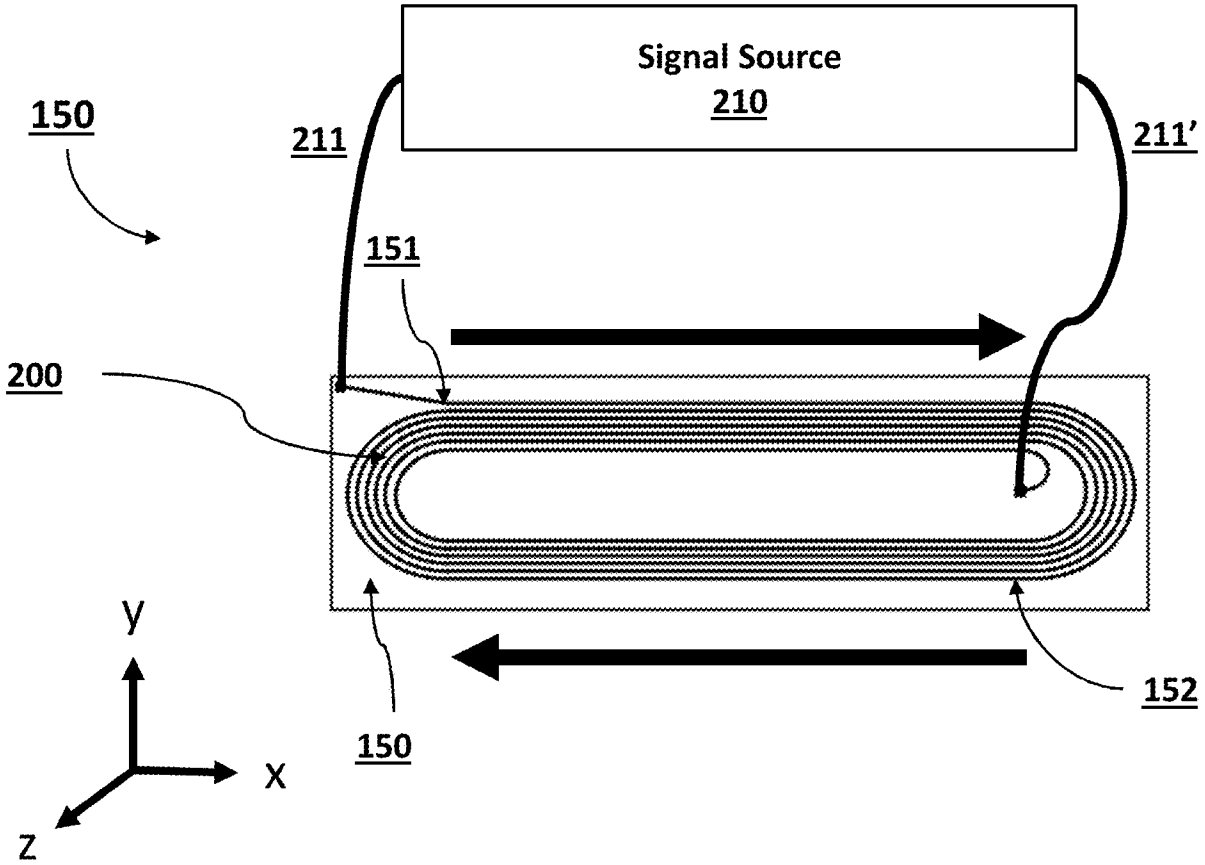
[Fig. 3B]

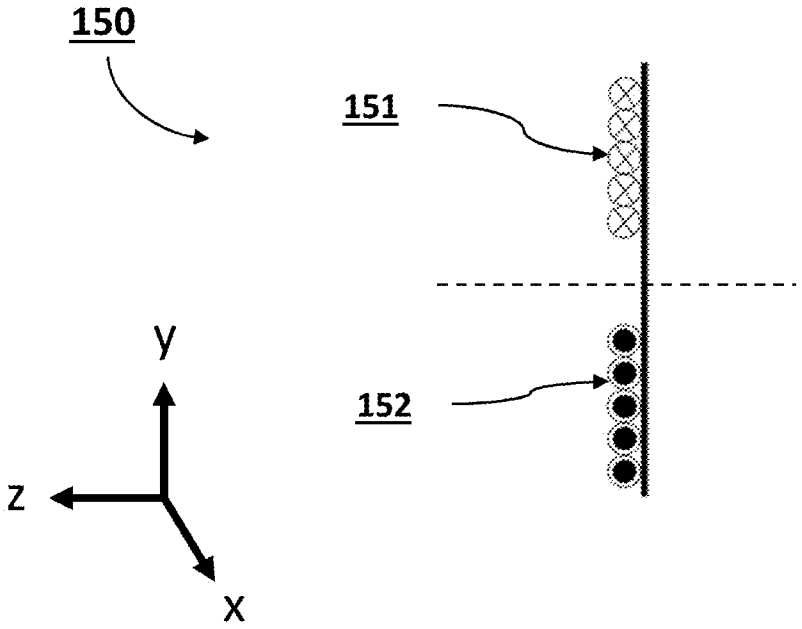
[Fig. 3C]

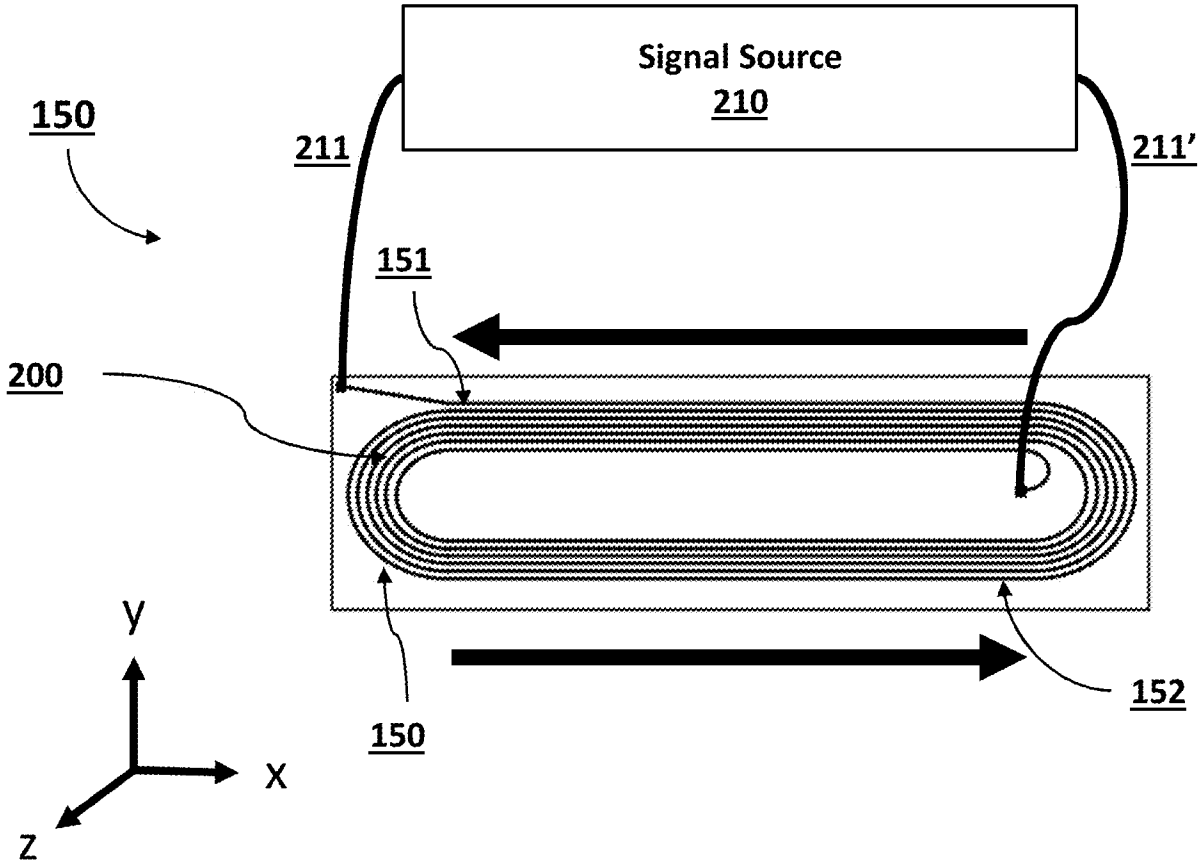
[Fig. 3D]

[Fig. 4]
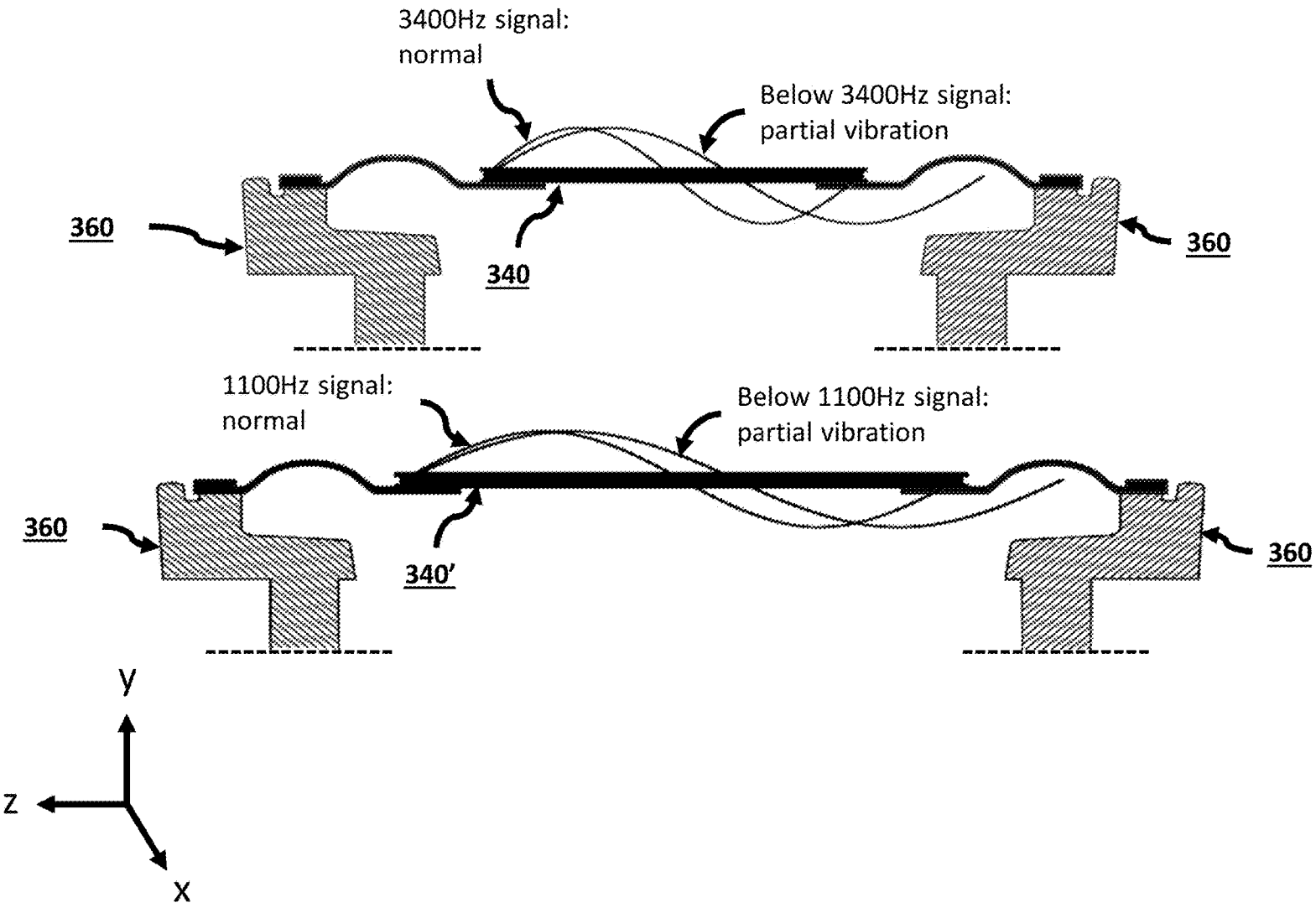

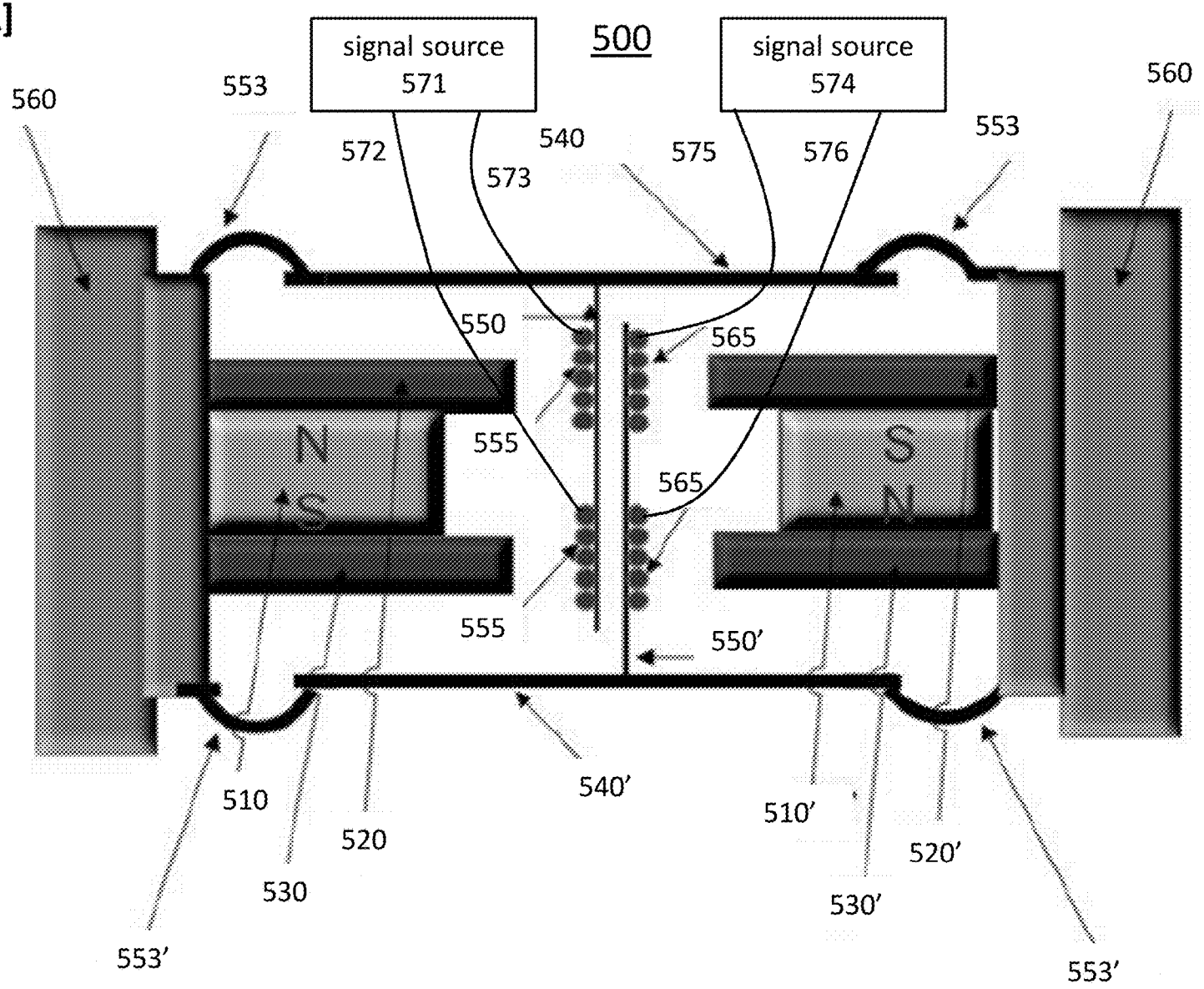
[Fig. 5A]

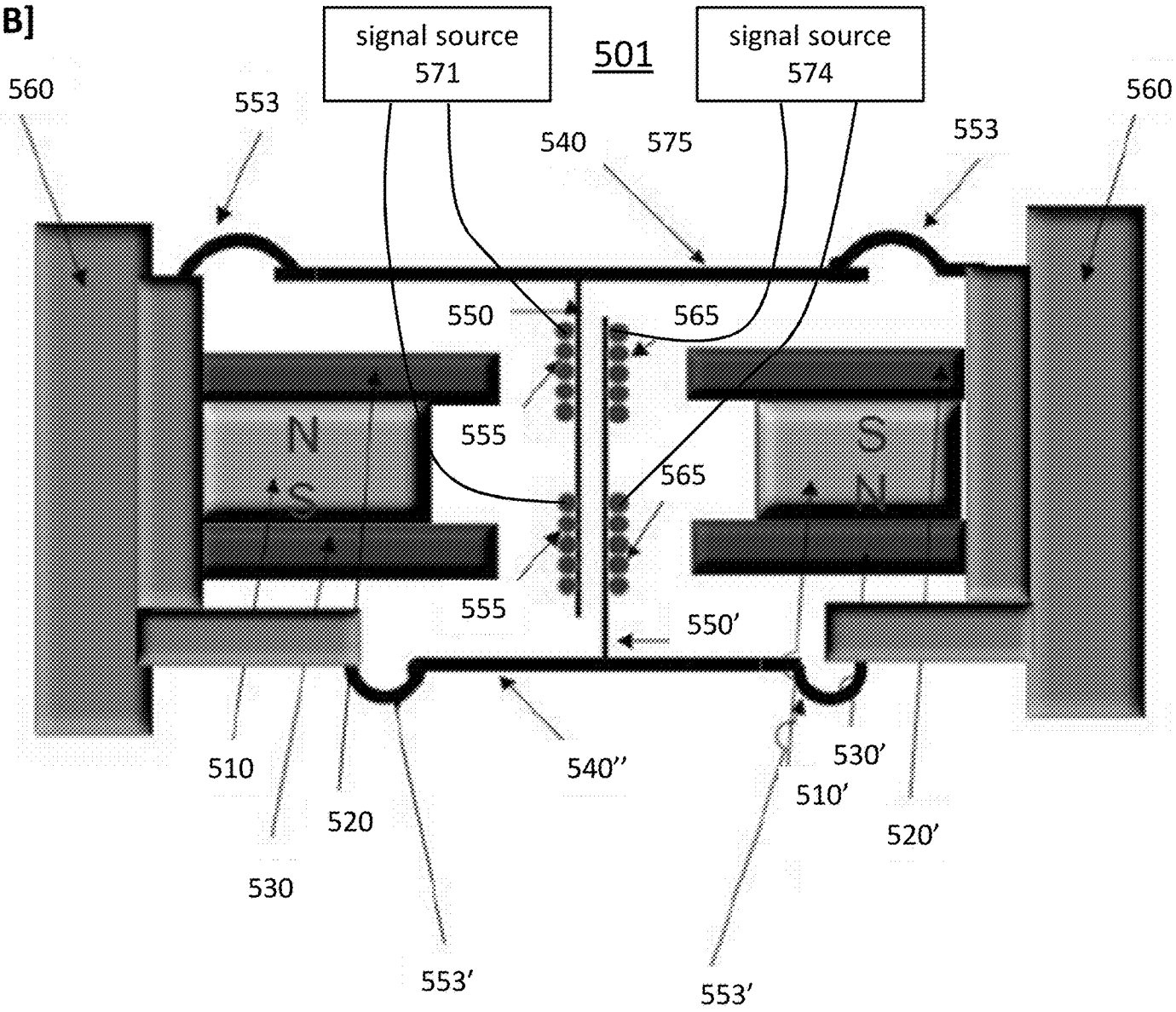
[Fig. 5B]

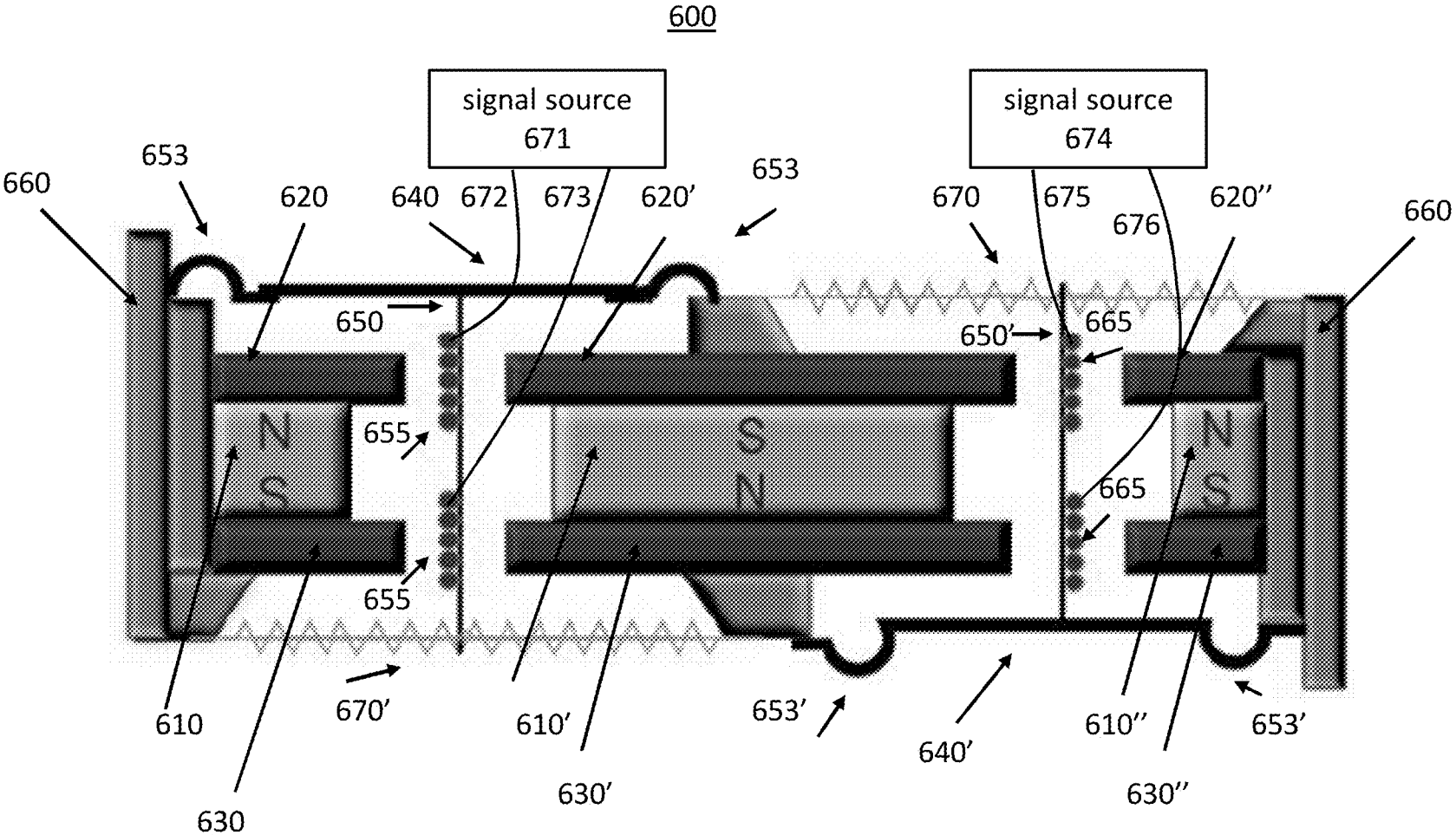
[Fig. 6A]

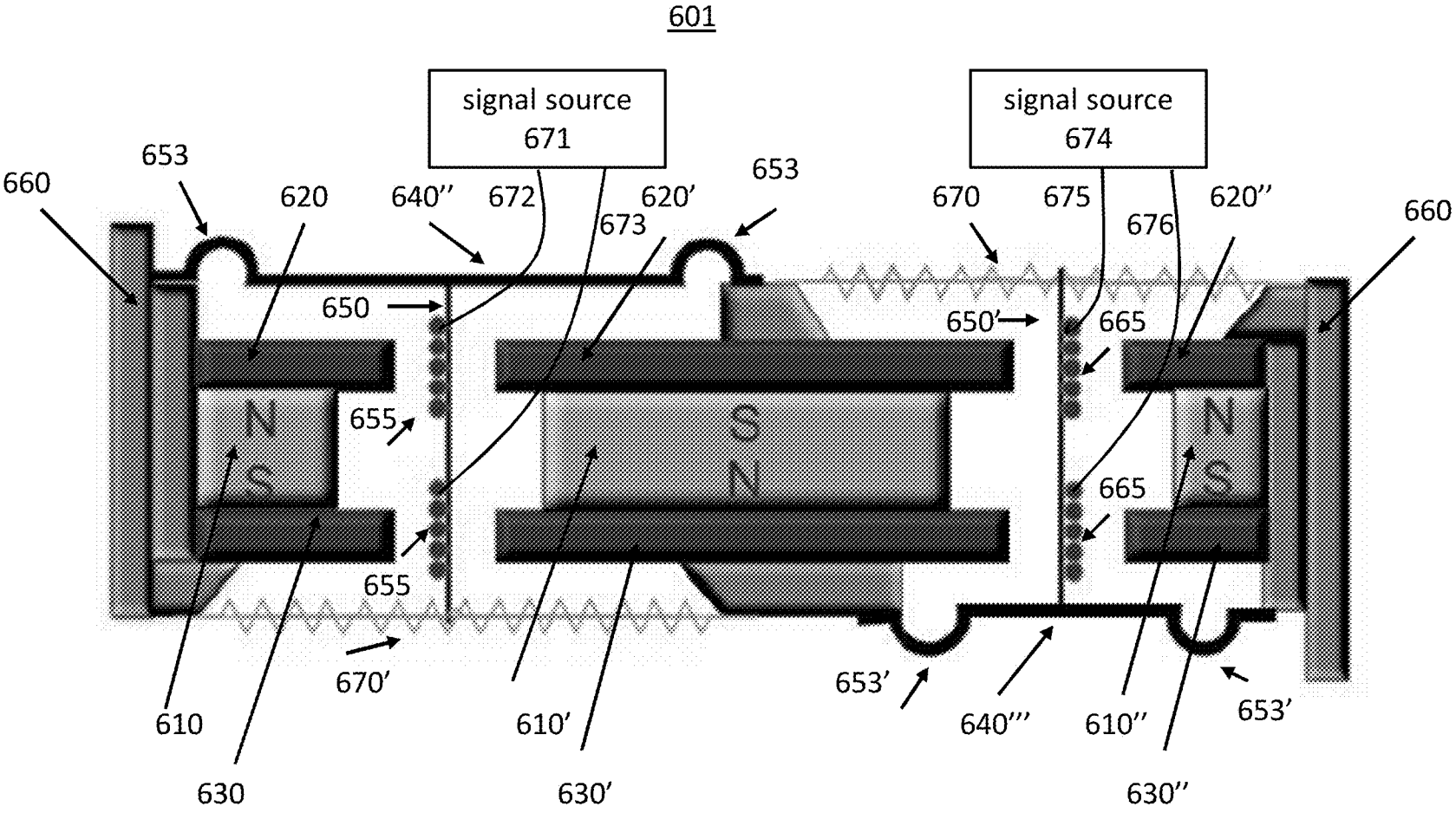
[Fig. 6B]

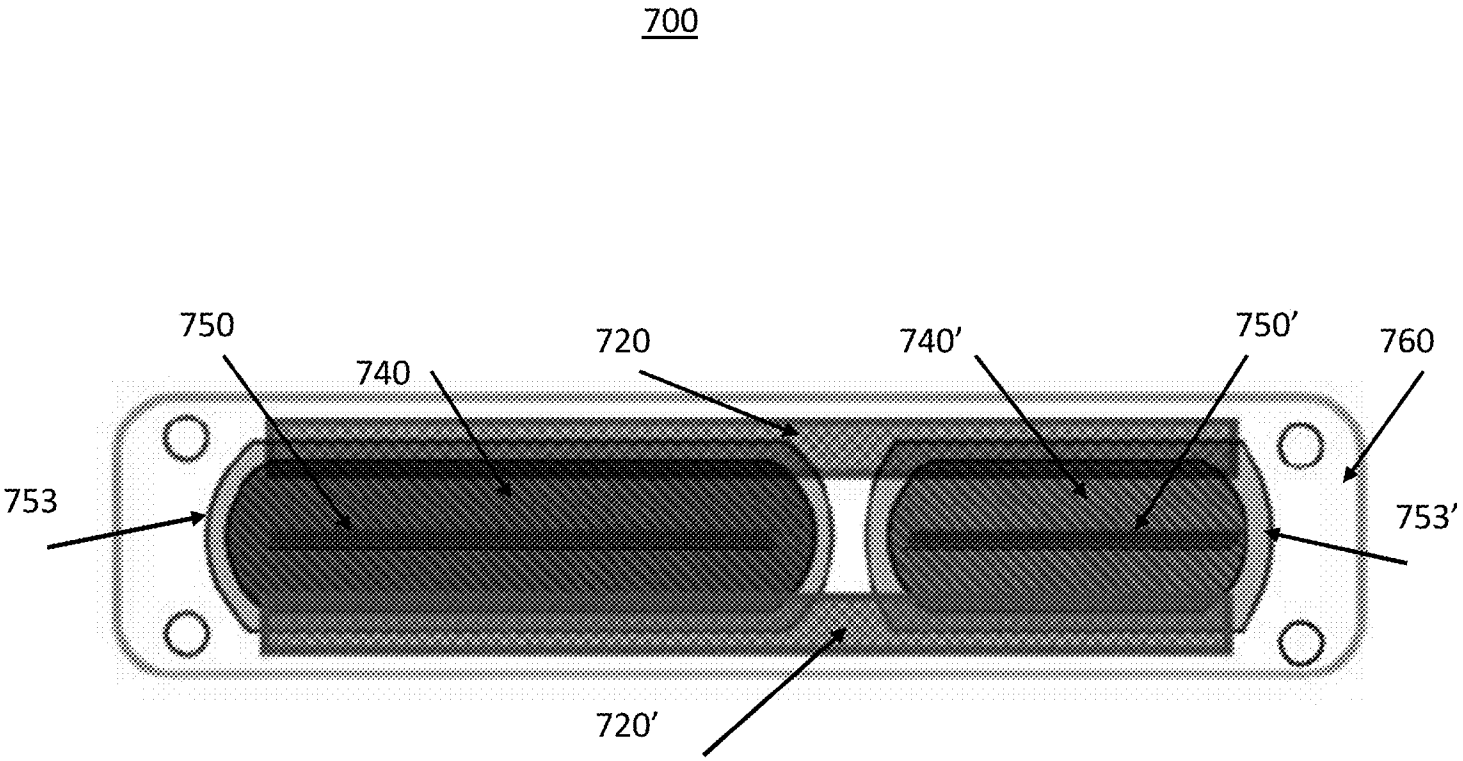
[Fig. 7A]

[Fig. 7C]
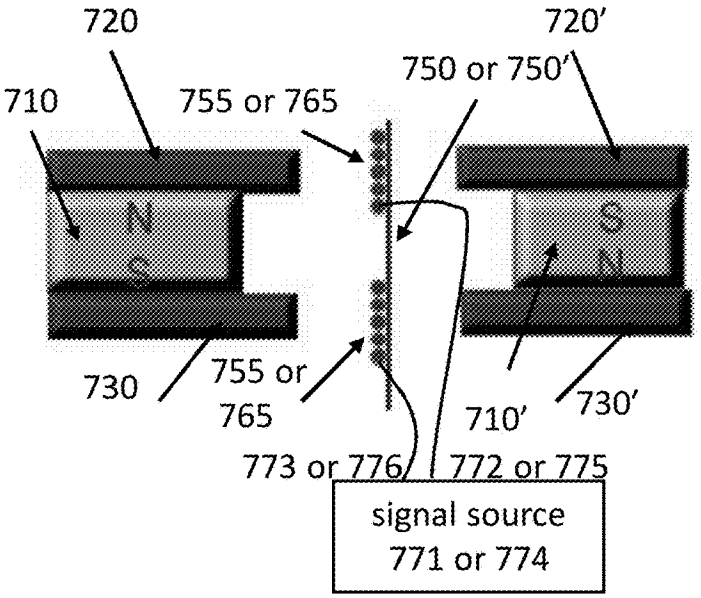
[Fig. 7B]
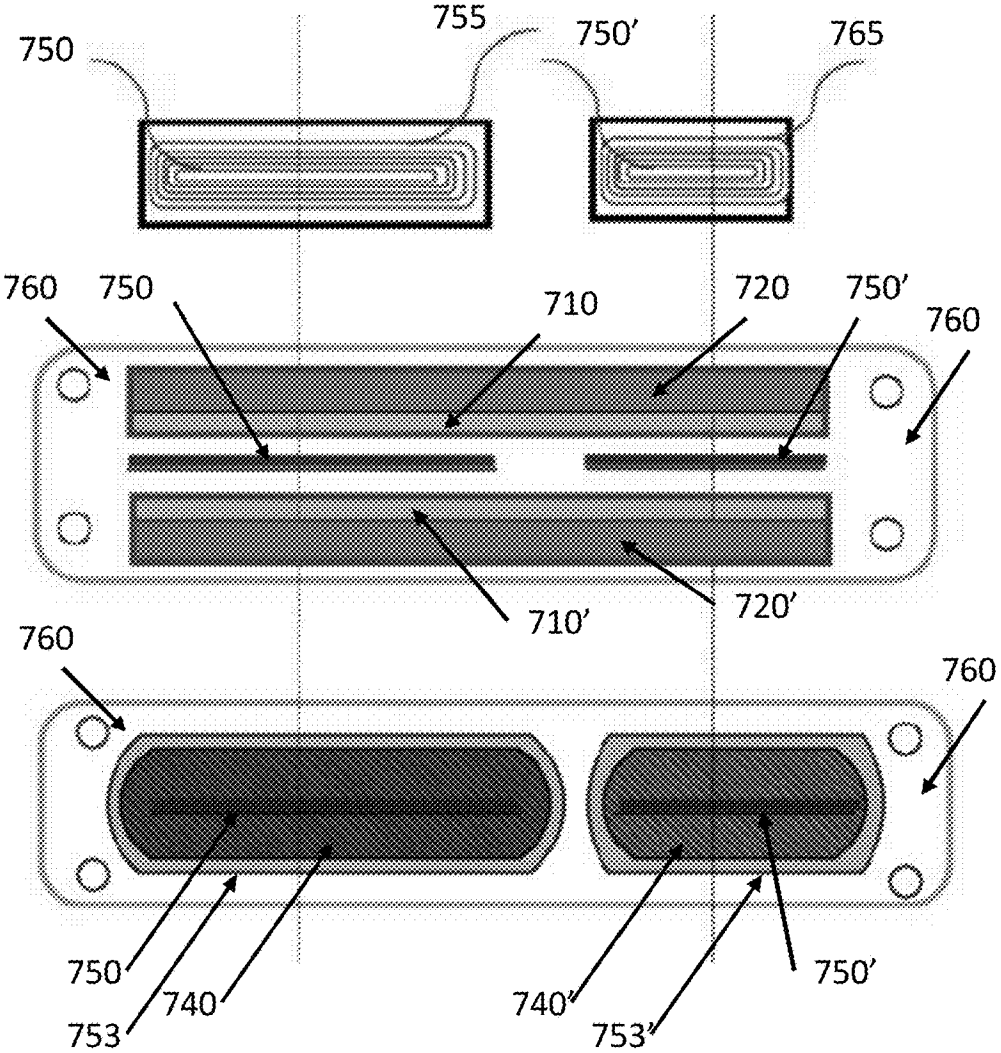

MULTI-DIAPHRAGM SPEAKER DRIVEN BY MULTIPLE VOICE COIL PLATES AND A SHARED PERMANENT MAGNET PAIR

PRIORITY CLAIM

This application claims priority to U.S. Provisional Patent Application No. 62/964,042, filed on Jan. 21, 2020, and titled, "Improved Speaker Design," which is incorporated by reference herein.

TECHNICAL FIELD

Embodiments are disclosed of a speaker containing multiple diaphragms. Each diaphragm is driven by its own voice coil plate, and at least two of the voice coil plates share a permanent magnet pair. In some embodiments, the speaker generates bi-directional sound. Optionally, the multiple diaphragms are of varying sizes, such that the diaphragms are configured to transmit different frequency ranges.

BACKGROUND OF THE INVENTION

A schematic illustration of commonly-used, prior art cone-type speaker 100 is shown in FIG. 1. Cone-type speaker 100 usually has a cylindrical shape and uses a cylindrical permanent magnet 10. Cone-type speaker 100 also comprises voice coil 11, diaphragm 12, basket/frame 13, and damper 14. Notably, because diaphragm 12 is cone-shaped, it has a significant height, which sets a limit on how thin the overall speaker structure can be. In addition, T-yoke 15 also has a significant height and sets a limit on how thin the overall speaker structure can be.

Moreover, the use of cylindrical magnet 10 forces the frame to adopt a closed-cone-shaped structure, which is, for practical consideration, limited from having multiple diaphragms driven by the same voice coil. The prior art also includes coaxial speakers, where multiple cone-shaped speakers are contained within a common structure, such as a tweeter being embedded within a woofer, but in those instances each speaker is driven by a separate voice coil and magnetic structure, and not the same voice coil and magnetic structure. Thus, in the prior art, the only multi-frequency range speakers that exist contain two separate speakers (with two diaphragms each driven by a separate voice coil and magnet) combined into one structure, which results in a more complicated structure and additional size and weight in the design.

Furthermore, in order to support the recent development of three-dimensional surround sound systems or other varieties of different sound reproduction that the industry requires, the speaker must be able to reproduce a broad range of sound signal with low distortion. The physical size of each diaphragm inherently limits the frequency range of sound that the diaphragm can produce effectively. A relatively small diaphragm is unable to reproduce low-frequency sound efficiently because the wavelength of the sound is larger than the diaphragm itself. On other hand, a relatively large diaphragm primarily designed to reproduce low-frequency sound may be ill-suited for reproducing high-frequency sound because larger prior art cone-shaped diaphragms often are not stiff enough to reproduce high-frequency sound without the occurrence of diaphragm breakup and modal behavior, resulting in significant distortion. The prior art lacks an efficient speaker structure that addresses both the spatial constraints and the requirement for a wide frequency range of sound. One prior art solution is to use multiple speakers of different frequency ranges set a certain distance apart from one another, but this method results in occupying an unnecessarily large space. Therefore, there exists a need for an improved speaker that can effectively reproduce a wide range of frequencies of sound but occupies less space than prior art speakers.

SUMMARY OF THE INVENTION

Embodiments are disclosed of a speaker containing multiple diaphragms. Each diaphragm is driven by its own voice coil plate, and at least two of the voice coil plates share at least one or more parts of a permanent magnet pair. In some embodiments, the speaker generates bi-directional sound. Optionally, the multiple diaphragms are of varying sizes, such that the diaphragms are configured to transmit different frequency ranges.

BRIEF DESCRIPTION OF THE DRAWINGS

Exemplary embodiments of the present invention are described with reference to the accompanying drawings, in which:

FIG. 1 depicts a conventional speaker with a cone-shaped structure.

FIG. 2 depicts an embodiment of a speaker comprising one diaphragm and a pair of bar magnets.

FIG. 3A depicts a cross-sectional embodiment of the voice coil and voice coil plate of FIG. 2 viewed along the x-axis with current flowing in a first direction, as indicated by standard "dot and cross" notation.

FIG. 3B depicts a side-view of the voice coil and voice coil plate viewed along the z-axis of FIG. 3A.

FIG. 3C is a schematic cross-sectional view of the voice coil plate of FIG. 3A with current flowing in the opposite direction, as indicated by standard "dot and cross" notation.

FIG. 3D depicts a side-view of the voice coil and voice coil plate viewed along the z-axis of FIG. 3C.

FIG. 4 shows the occurrence of partial vibration due to low frequency, long wavelength sound relative to the size of the diaphragm.

FIG. 5A depicts an embodiment of a speaker comprising multiple diaphragms and multiple voice coil plates that share both components of a pair of bar magnets.

FIG. 5B depicts another embodiment of a speaker comprising multiple diaphragms of different sizes to produce a different range of frequencies and multiple voice coil plates that share both components of a pair of bar magnets.

FIG. 6A depicts an embodiment of a speaker comprising multiple diaphragms and multiple voice coil plates that share just a single common magnet in two pairs of bar magnets.

FIG. 6B depicts another embodiment of a speaker comprising multiple diaphragms of different sizes to produce a different range of frequencies and multiple voice coil plates that share just a single common magnet in two pairs of bar magnets.

FIG. 7A depicts an external top view of an embodiment of a speaker comprising multiple diaphragms and multiple voice coil plates, within the same horizontal plane, that share a bar magnet pair.

FIG. 7B depicts an exploded view of the speaker of FIG. 7A.

FIG. 7C depicts a voice coil plate and pair of bag magnets used in the speaker of FIG. 7A.

DETAILED DESCRIPTION OF THE PREFERRED EMBODIMENT

Features and advantages of the present invention described above will become apparent from the following descriptions in conjunction with the accompanying drawings. According to the descriptions, a person with the proper technical expertise will be able to execute the technical idea illustrated in this present invention in the relevant industry. Since this invention can have a variety of different applications and may take different forms and shapes, only specific examples are illustrated through Figures and the detailed descriptions are found in the main text. However, this is by no means to restrict the present invention to the particular form disclosed; its derivations, equivalents, and substitutes must be understood as embracing all included in the scope of the present invention. The terms used herein are merely used to describe particular examples and are not intended to limit the present invention.

FIG. 2 depicts a speaker design utilizing a single diaphragm and a pair of bar magnets. Speaker 200 comprises bar magnets 110 and 110', upper magnetic yokes 120 and 120', lower magnetic yokes 130 and 130', diaphragm 140, and voice coil plate 150. Speaker 200 further comprises speaker frame 160. Bar magnets 110 and 110' comprise a pair of bar magnets that are positioned with a predetermined distance in between such that the different polarities are facing each other. On one end, voice coil plate 150 is secured to speaker frame 160 through diaphragm 140, and on the other end, voice coil plate 150 is secured to speaker frame 150 through a damper 170 or through a second diaphragm (not shown).

Upper magnetic yokes 120 and 120' are attached to the upper part of bar magnets 110 and 110' in the same plane, and lower magnetic yokes 130 and 130' are attached to the lower part of bar magnets 110 and 110' in the same plane. Upper magnetic yokes 120 and 120' and lower magnetic yokes 130 and 130' contain and direct the magnetic field in the area between the magnets where the voice coil resides. Upper magnetic yokes 120 and 120' and lower magnetic yokes 130 and 130' optionally may extend beyond bar magnets 110 and 110' into the magnetic gap to increase the magnetic flux density induced in the magnetic gap. Furthermore, magnetic yokes 120 and 120' optionally may comprise the same magnetic yoke, and magnetic yokes 130 and 130' optionally may comprise the same magnetic yoke.

Diaphragm 140 is positioned either above upper yokes 120 and 120' or below lower yokes 130 and 130'. In this case, diaphragm 140 must be configured to produce the corresponding frequency range sound accordingly with the size of diaphragm 140. In this embodiment, diaphragm 140 is substantially flat. However, diaphragm 140 instead could be convex or concave, or any shape with respect to the top surface of the frame designed for any application-related acoustic design.

FIGS. 3A, 3B, 3C, and 3D taken from the context of FIG. 2 demonstrate the operation method of the speaker. Voice coil plate 150 must be positioned in a substantially rigid, planar form in the gap between bar magnets 110 and 110'. Coil 151/152 can be placed on one side of voice coil plate 150 or on both sides. Diaphragm 140 will be vibrated at a specific frequency range by the magnetic field induced by the pair of bar magnets 110 and 110' and the electric current flowing in the coil 151/152.

During operation, coil 151/152 receives an electrical audio signal from a signal source 210 over conductors 211 and 211'. A magnetic field is induced by bar magnets 110 and 110', generally in the direction from the north poles (N) to the south poles (S). During the first half of the signal cycle (defined as the "positive half-cycle"), current flows through coil 151 of FIG. 3A "out of the page", and current flows through coil 152 of FIG. 3A "into the page", according to the "dot and cross" standard convention for electrical current flowing through the plane of the page. This direction of current flow is shown from a different point of view in FIG. 3B. When the voice coil plate 150 and coupled voice coil 200 are installed in the context of FIG. 2, Lorentz forces are generated both by coil 151 interacting with the magnetic field between top magnetic yokes 120 and 120' and by coil 152 interacting with the magnetic field between bottom magnetic yokes 130 and 130', with the forces aligned in the same direction and pushing voice coil plate 150 upward, which pushes diaphragm 140 upward according to the magnitude of the electrical signal from the signal source. During the second half of the signal cycle (defined as the "negative half-cycle"), current flows through coil 151 of FIG. 3*c* "into the page", and current flows through coil 152 of FIG. 3C "out of the page", according to the standard "dot and cross" convention for electrical current flowing through the plane of the page. Since the direction of the current in both 151 and 152 of the voice coil is reversed, then the Lorentz forces from the interaction with the magnetic field between 120,120' and 130,130', respectively, will align in the same direction to push voice coil plate 150 downward, which pulls diaphragm 140 downward according to the magnitude of the electrical signal from the signal source.

In all embodiments of the speaker, both those already mentioned and to be mentioned later in this patent, each voice coil may be comprised of any electrically-conductive material, including but not limited to, any variant of copper wire, printed circuit board, flexible printed circuit board, or other conductive metal or alloy.

Diaphragm 140 may be connected to frame 160 with connector 153 shown in FIG. 2, which can be made from a flexible material such as rubber, and which connects to diaphragm 140 and frame 160. Thus, the electric audio signal from the signal source is translated into kinetic energy to move diaphragm 140, reproducing sound.

FIG. 4 depicts the cause of partial vibration with respect to low and high frequency signals based on the size of the diaphragm. For example, assuming that the speed of sound is 340 m/s, if diaphragm 340 is 10 cm wide in its maximum extent, then the frequency range of diaphragm 340 will be effectively 3400 Hz or higher. If the diaphragm 340' is 30 cm in its maximum extent, then the frequency range of diaphragm 340' will be approximately 1100 Hz or higher. As a result, diaphragm 340 can successfully output signals with frequencies higher than 3400 Hz, but signals lower than 3400 Hz would cause partial vibration of diaphragm 340 due to the wavelength of the audio signal being larger than the diaphragm itself. Similarly, diaphragm 340' can successfully output signals with frequencies higher than approximately 1100 Hz, but signals lower than approximately 1100 Hz would cause partial vibration of 2nd diaphragm 340' due to the wavelength of the audio signal produced being larger than the diaphragm itself. Partial vibrations of a diaphragm results in distorted sound and inaccurate reproduction of sound from signal source 210.

The sizes of diaphragms 340 and 340' can be described by their length along the x-axis and width along the z-axis. Also, the shapes of diaphragms 340 and 340' can be circular, elliptical, rectangular or any combination of these, and they can be flat, convex, or concave along the y-axis. In the example shown, diaphragms 340 and 340' are flat and have minimal height along the y-axis, which is a significant difference from diaphragm 12 in speaker 100, which allows speaker 300 to be thinner than speaker 100. These variations are optional and are made more practical to implement by the present invention.

As the sizes of diaphragms 340 and 340' increase along the x-axis and/or z-axis, the distance between diaphragms 340 and 340' can be increased or decreased as needed. The distance between diaphragms 340 and 340' can be determined based on the interference or distortion effect between their respective frequency ranges.

FIG. 5A depicts speaker 500. Speaker 500 comprises bar magnets 510 and 510', upper magnetic yokes 520 and 520', lower magnetic yokes 530 and 530', diaphragms 540 and 540', voice coil plates 550 and 550', coils 555 and 565, and connectors 553 and 553'. Speaker 500 further comprises speaker frame 560. Bar magnets 510 and 510' comprise a pair of bar magnets that are positioned with a predetermined distance in between such that the different polarities are facing each other. On one end, voice coil plate 550 is secured to speaker frame 560 through diaphragm 540 and connector 553, and on the other end, voice coil plate 550' is secured to speaker frame 560 through diaphragm 540' and connector 553'. Connectors 553 and 553' can be made from a flexible material such as rubber.

Upper magnetic yokes 520 and 520' are attached to the upper part of bar magnets 510 and 510' in the same plane, and lower magnetic yokes 530 and 530' are attached to the lower part of bar magnets 510 and 510' in the same plane. Upper magnetic yokes 520 and 520' and lower magnetic yokes 530 and 530' contain and direct the magnetic field in the area between the magnets where the voice coil resides. Upper magnetic yokes 520 and 520' and lower magnetic yokes 530 and 530' optionally may extend beyond bar magnets 510 and 510' into the magnetic gap to increase the magnetic flux density induced in the magnetic gap. Furthermore, magnetic yokes 520 and 520' optionally may comprise the same magnetic yoke, and magnetic yokes 530 and 530' optionally may comprise the same magnetic yoke.

Diaphragm 540 is positioned above upper yokes 520 and 520'. In this case, diaphragm 540 must be configured to produce the corresponding frequency range sound accordingly with the size of diaphragm 540. In this embodiment, diaphragm 540 is substantially flat. However, diaphragm 540 instead could be convex or concave, or any shape with respect to the top surface of the frame designed for any application-related acoustic design.

Diaphragm 540' is positioned below lower yokes 530 and 530'. In this case, diaphragm 540' must be configured to produce the corresponding frequency range sound accordingly with the size of diaphragm 540'. In this embodiment, diaphragm 540' is substantially flat. However, diaphragm 540' instead could be convex or concave, or any shape with respect to the top surface of the frame designed for any application-related acoustic design.

In the example shown in FIG. 5A, diaphragms 540 and 540' are approximately the same size.

During operation, coil 555 receives an electrical audio signal from signal source 571 over conductors 572 and 573, and coil 565 receives an electrical audio signal from signal source 574 over conductors 575 and 576.

FIG. 5B depicts speaker 501, which is substantially the same as speaker 500 except that diaphragm 540' has been replaced by diaphragm 540". Diaphragm 540" is smaller in size than diaphragm 540.

In FIGS. 5A and 5B, diaphragm 540 has a width of W1, diaphragm 540' has a width of W1, and diaphragm 540" has a width of W2, where W1>W2. The widths of diaphragms 540, 540', and 540" can be modified to suit different frequency ranges. For example, by increasing the sizes W1 and W2, it is possible to lower the frequency ranges of diaphragms 540, 540', and 540", which allows the speaker to play a different ranges of frequencies compared to speaker 300 in FIG. 3. On the other hand, by decreasing the sizes W1 and W2, it is possible to raise the frequency ranges of diaphragms 540, 540', and 540". In FIG. 5B, diaphragm 540 can play a lower frequency range than diaphragm 540". Here, signal source 571 and signal source 574 can coordinate or filter their signals such that coil 555 receives signals of a lower frequency range (such as 100 Hz to 1000 Hz) and coil 565 receives signals of a higher frequency range (such as 1000 Hz to 5000 Hz).

The Lorentz forces are generated in speakers 500 and 501 in the same manner described previously for FIG. 2, except here voice coil plate 550 acts independently on diaphragm 540 in FIGS. 5A and 5B, and voice coil plate 550' acts independently on diaphragm 540' in FIG. 5A and on diaphragm 540" in FIG. 5B.

FIG. 6A depicts speaker 600. Speaker 600 comprises bar magnets 610, 610' and 610"; upper magnetic yokes 620, 620', and 620"; lower magnetic yokes 630, 630', and 630"; diaphragms 640 and 640'; voice coil plates 650 and 650'; coils 655 and 665; dampers 670 and 670'; and connectors 653 and 653'. Optionally, dampers 670 and 670' can be replaced with additional diaphragms. Speaker 600 further comprises speaker frame 660.

Coil 655 can be placed on either side of voice coil plate 650 or on both sides. Coil 665 can be placed on either side of voice coil plate 650' or on both sides.

Bar magnets 610 and 610' comprise a pair of bar magnets that are positioned with a predetermined distance in between such that the different polarities are facing each other. Similarly, bar magnets 610' and 610" comprise a pair of bar magnets that are positioned with a predetermined distance in between such that the different polarities are facing each other.

On one end, voice coil plate 650 is secured to speaker frame 660 through diaphragm 640 and connector 653, and on the other end, voice coil plate 650' is secured to speaker frame 660 through diaphragm 640' and connector 653'. Connectors 653 and 653' can be made from a flexible material such as rubber.

Upper magnetic yokes 620, 620', and 620" are attached to the upper part of bar magnets 610, 610', and 610", respectively, in the same plane, and lower magnetic yokes 630, 630', and 630" are attached to the lower part of bar magnets 610, 610', and 610" in the same plane. Upper magnetic yokes 620, 620', and 620" and lower magnetic yokes 630, 630', and 630" contain and direct the magnetic field in the area between the magnets where the voice coil resides. Upper magnetic yokes 620, 620', and 620" and lower magnetic yokes 630, 630', and 630" optionally may extend beyond bar magnets 610, 610', and 610" into the magnetic gaps to increase the magnetic flux density induced in the magnetic gaps.

Diaphragm 640 is positioned above upper yokes 620 and 620'. In this case, diaphragm 640 must be configured to produce the corresponding frequency range sound accordingly with the size of diaphragm 640. In this embodiment, diaphragm 640 is substantially flat. However, diaphragm 640 instead could be convex or concave, or any shape with respect to the top surface of the frame designed for any application-related acoustic design.

Diaphragm 640' is positioned below lower yokes 630' and 630". In this case, diaphragm 640' must be configured to produce the corresponding frequency range sound accordingly with the size of diaphragm 640'. In this embodiment, diaphragm 640' is substantially flat. However, diaphragm 640' instead could be convex or concave, or any shape with respect to the top surface of the frame designed for any application-related acoustic design.

During operation, coil 655 receives an electrical audio signal from signal source 671 over conductors 672 and 673, and coil 665 receives an electrical audio signal from signal source 674 over conductors 675 and 676.

In the example shown in FIG. 5A, diaphragms 540 and 540' are approximately the same size.

FIG. 6B depicts speaker 601, which is substantially the same as speaker 600 except that diaphragm 640 has been replaced by diaphragm 640", and diaphragm 640' has been replaced by diaphragm 640'.

In FIGS. 6A and 6B, diaphragm 640 has a width of W1, diaphragm 640' also has a width of W1, diaphragm 640" also has a width of W1, but diaphragm 640'" has a width of W2, where W1=W1=W1>W4, such that diaphragm 640 has the same frequency range as diaphragms 640' and 640", while diaphragm 640' has a higher frequency range than any of the diaphragms 640, 640', or 640".

The Lorentz forces are generated in speakers 600 and 601 in the same manner described previously for FIG. 2, except here voice coil plate 650 acts on diaphragm 640 and voice coil plate 650' acts on diaphragm 640' in FIG. 6A, and voice coil plate 650 acts on diaphragm 640" and voice coil plate 650' acts on diaphragm 640'" in FIG. 6B. Additionally, the magnetic field lines are generated with two pairs of bar magnets in which each pair share a single common magnet.

FIGS. 7A, 7B, and 7C depict speaker 700. Speaker 700 comprises bar magnets 710 and 710', upper magnetic yokes 720 and 720', lower magnetic yokes 730 and 730', diaphragms 740 and 740', voice coil plates 750 and 750', coils 755 and 765, and connectors 753 and 753'. Speaker 700 further comprises speaker frame 760. Bar magnets 710 and 710' comprise a pair of bar magnets that are positioned with a predetermined distance in between such that the different polarities are facing each other. On one end, voice coil plate 750 is secured to speaker frame 760 through diaphragm 740 and connector 753, and on the other end, voice coil plate 750' is secured to speaker frame 760 through diaphragm 740' and connector 753'. Connectors 753 and 753' can be made from a flexible material such as rubber. On the opposite side of speaker 700, voice coil plates 750 and 750' are secured to speaker frame 760 optionally through a damper (not shown) or optionally through another set of diaphragms (not shown).

Upper magnetic yokes 720 and 720' are attached to the upper part of bar magnets 710 and 710' in the same plane, and lower magnetic yokes 730 and 730' are attached to the lower part of bar magnets 710 and 710' in the same plane. Upper magnetic yokes 720 and 720' and lower magnetic yokes 730 and 730' contain and direct the magnetic field in the area between the magnets where the voice coil resides. Upper magnetic yokes 720 and 720' and lower magnetic yokes 730 and 730' optionally may extend beyond bar magnets 710 and 710' into the magnetic gap to increase the magnetic flux density induced in the magnetic gap. Furthermore, magnetic yokes 720 and 720' optionally may comprise the same magnetic yoke, and magnetic yokes 730 and 730' optionally may comprise the same magnetic yoke.

Diaphragm 740 is positioned above upper yokes 720 and 720'. In this case, diaphragm 740 must be configured to produce the corresponding frequency range sound accordingly with the size of diaphragm 740. In this embodiment, diaphragm 740 is substantially flat. However, diaphragm 740 instead could be convex or concave, or any shape with respect to the top surface of the frame designed for any application-related acoustic design.

Diaphragm 740' is positioned above upper yokes 720 and 720' as well. In this case, diaphragm 740' must be configured to produce the corresponding frequency range sound accordingly with the size of diaphragm 740'. For example, signal source 771 and signal source 774 can coordinate or filter their signals such that coil 755 receives signals of a lower frequency range (such as 100 Hz to 1000 Hz) and coil 765 receives signals of a higher frequency range (such as 1000 Hz to 5000 Hz). In this embodiment, diaphragm 740' is substantially flat. However, diaphragm 740' instead could be convex or concave, or any shape with respect to the top surface of the frame designed for any application-related acoustic design.

During operation, coil 755 receives an electrical audio signal from signal source 771 over conductors 772 and 773, and coil 765 receives an electrical audio signal from signal source 774 over conductors 775 and 776.

The Lorentz forces are generated in speaker 700 in the same manner described previously for FIG. 2, except here voice coil plate 750 acts on diaphragm 740 and voice coil plate 750' acts on diaphragm 740'.

According to the examples discussed before, unlike traditional speakers such as speaker 100, it is possible to realize rectangular shaped, flat speakers instead of circular speakers, to simplify parts holding the voice coil plate and multiple diaphragms, to play multi-frequency range sounds at the same time by varying the sizes of diaphragms, and to play a wide range of sounds in general.

According to the embodiments described herein, the output direction of the speaker can be controlled by changing the direction of current flowing in the voice coil plate, and a multi-frequency range sound can be effectively played by having different sizes of diaphragms.

According to the embodiments described herein, an enhancement in sound pressure level and ability to play multi-range sound while having an ultra-thin form can be achieved by placing differently sized diaphragms and adjusting the distances between the diaphragms.

The embodiments allows speakers to be ultra-light and ultra-thin which perfectly aligns with the demands for speakers used in thin and light objects.

The embodiments described herein can effectively produce multi-range sounds by having multiple diaphragms with different sizes along with multiple and independent voice coils to control those diaphragms. The control signal determining the appropriate range of signal frequency and choosing appropriate diaphragm to output can be created by a controller or a processor. Such controller or processor responsible for creating control signals can be implemented by a combination of hardware and software.

In software implementation, not only the procedures and functions described in this document, but also each component and operation in this invention can be implemented using an appropriate programming language. Each software module is responsible for one or more procedures or functions described in this document. Implemented software codes can be stored in electronic memory and can be executed by a controller or processor.

Using this invention, by using an AC electrical signal to stimulate the voice coils, and by implementing differently-sized diaphragms which are coupled to the voice coils and move accordingly, sound with a wide range of frequency can be reproduced efficiently. This type of speaker can be miniaturized and optimized to produce ideal sound output even in products that require an ultra-thin form factor. Also, the distance between the diaphragms can be determined to address any interference or distortion effects between the chosen frequency ranges for each diaphragm.

Several opportunities exist to use this technology across many industries. For example, automobiles, or even other types of vehicles such as boats, trains, and airplanes, may benefit from the ability to closely co-locate multiple frequency ranges in order to cover the entire audible spectrum effectively, all while maintaining an ultra-thin form factor. Furthermore, home IoT products could enjoy more effective coplanar integration of broadband sound produced by multiple diaphragms. Lastly, "hi-fi" home audio systems may benefit from new configurations offering options for more aesthetic design and flexibility with space considerations.

Another advantage offered by the embodiments is natural efficient broadband frequency coverage. Like in a conventional speaker, the frequency range capabilities of a speaker are heavily dependent on the surface area, shape, and material of the diaphragm. However, in conventional design, each speaker's surface must be designed separately to address different frequency ranges. This multi-diaphragm structure allows diaphragm surfaces with different lengths and widths to be included within the same speaker magnetic structure, with the caveat that each diaphragm is controlled by independently operating voice coils. By the nature of their direct attachment by glue or another method to the voice coil, they can be designed to be coplanar, or otherwise similarly powered, in-phase surfaces. Yet, these surfaces are designed differently and are all powered by the motion of one, or several shared, magnetic structures with multiple voice coils all controlling the same, or differently sized diaphragms, either in the same plane or not. One advantage of the embodiments described herein over the prior art is that the use of multiple, independently operating voice coils that act on different, independent diaphragms in the embodiments provides a wider range of frequencies relative to the overall space occupied by the speaker.

Yet another advantage offered by the embodiments is cooperative variation of surface design. Conventional sound systems often implement different speaker drivers with different surface materials to achieve different properties. These speakers are installed as separate components in such a way that they can cooperate to achieve a higher overall sound quality than the parts alone. However, the limitation is that in order to use these different materials, multiple speaker drivers must be used. There are a few design variations which exist, such as coaxial speakers, but they still include multiple electromechanical motors for different diaphragms within their structure. With the present invention, to improve upon the original speaker structure, these multiple diaphragms may be implemented with different materials and different curvatures in addition to their configuration and attachment to the voice coil plates. One surface, for example, might be designed as a soft-dome tweeter while another is designed from a stiff material for a subwoofer A final advantage offered by the embodiments is control of sound directivity. The end use of a speaker often demands a specific type of directivity, such as a wide dispersion, a narrow dispersion, or something in between. The surface orientation and curvature can offer better control over the directivity of the sound, whether the goal is to focus the sound in one particular direction or broaden its dispersion.

All of these advantages can be seen to come to fruition in the design of, for example, a soundbar with true full range capabilities to play 20 Hz to 20 Khz and that can fit in a single plane in the space that a soundbar using conventional drivers would be placed. However, with the realized advantages described here, a single monolithic driver can be placed in an appropriate enclosure to allow true full range sound to achieve performance that in the prior art would have required more space and additional drivers.

Additionally, these advantages can be seen to improve what is known as a line array speaker system. Traditionally, many smaller drivers are joined together in a system to deliver unique and directional full range sound, but this system requires the use of smaller drivers joined together to achieve this, and thus a great many small drivers to achieve the low end response for true full range sound. Because of the nature of the co-planar driver described in this patent, the unique and directed full range sound of a line array system can be achieved with a fraction of the drivers because the low end response can be handled by a single, larger diaphragmed driver in the same linear plane as the drivers that handle the rest of the sound, allowing for the benefits of a line array without the added complexity of many drivers. One place this may be of great interest is in the auto-sound realm where line array system can provide a directed and unique sound experience, including personal active noise cancellation, for individuals in the vehicle. This could include things like the driver better hearing road noises that others in the car would have no interest in, or children in the back seat watching a movie. The invention described in this patent can allow this reality to be more easily achieved.

A final example use case to consider is that of the in home or home theatre application. Because of the unique co-planar structure of the invention described in this patent, a single line of drivers recessed in a wall on either side and above or below a TV or home theatre screen can provide immersive full sound audio while maintaining the aesthetic quality desired in a living room or home theatre application. The use of in-wall speakers is not a new idea, but using the described invention to more easily and beautifully mate the aesthetic and functional is a step in a new direction.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances, including, but not limited to, for example, data and information. It should be understood that, while these words, and/or other words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A speaker comprising:

a first bar magnet comprising a north pole and a south pole;

a second bar magnet comprising a north pole and a south pole, the second bar magnet located a predefined distance from and parallel to the first bar magnet with the north pole of the second bar magnet facing the south pole of the first bar magnet and the south pole of the second bar magnet facing the north pole of the first bar magnet;

a third bar magnet comprising a north pole and a south pole, the third bar magnet located a predefined distance from and parallel to the second bar magnet with the north pole of the third bar magnet facing the south pole of the second bar magnet and the south pole of the third bar magnet facing the north pole of the second bar magnet;

a first voice coil plate located between the first bar magnet and the second bar magnet, the first voice coil plate comprising a first coil for receiving a first electrical signal;

a second voice coil plate located between the second bar magnet and the third bar magnet, the second voice coil plate comprising a second coil for receiving a second electrical signal;

a first diaphragm on a first side of the speaker and attached to an end of the first voice coil plate; and a second diaphragm on a second side of the speaker and attached to an end of the second voice coil plate, wherein the second side is opposite the first side;

a first damper on the first side of the speaker and attached to an end of the first voice coil plate opposite the first diaphragm;

a second damper on the second side of the speaker and attached to an end of the second voice coil plate opposite the second diaphragm;

wherein the first voice coil plate vibrates the first diaphragm in response to force generated by the electrical signal in the first coil and a magnetic field between the first bar magnet and the second bar magnet and the second voice coil plate vibrates the second diaphragm in response to force generated by the electrical signal in the second coil and a magnetic field between the first bar magnet and the second bar magnet.

2. The speaker of claim 1, wherein the first diaphragm and the second diaphragm are of different sizes.

3. The speaker of claim 2, wherein the first diaphragm is capable of reproducing sound within a first frequency range and the second diaphragm is capable of reproducing sound within a second frequency range different than the first frequency range.

4. The speaker of claim 1, further comprising:

a first magnetic yoke attached to a first side of the first bar magnet;

a second magnetic yoke attached to a first side of the second bar magnet;

a third magnetic yoke attached to a first side of the third bar magnet;

a fourth magnetic yoke attached to a second side of the first bar magnet;

a fifth magnetic yoke attached to a second side of the second bar magnet;

a sixth magnetic yoke attached to a second side of the third bar magnet.

5. The speaker of claim 1, further comprising:

a frame which may enclose the speaker.

6. The speaker of claim 1, wherein the first voice coil plate comprises a first printed circuit board and wherein an etched coil is etched into a plurality of layers within the first printed circuit board and the second voice coil plate comprises a second printed circuit board and wherein an etched coil is etched into a plurality of layers within the second printed circuit board.

7. The speaker of claim 6, wherein two or more of the layers in the plurality of layers in the first printed circuit board are connected by one or more vias to combine each layer's etched coil in series or parallel, and wherein two or more of the layers in the plurality of layers in the second printed circuit board are connected by one or more vias to combine each layer's etched coil in series or parallel.

8. The speaker of claim 7, wherein one or more vias in the first printed circuit board are attached to control gates that can be turned on or turned off to alter the impedance of the speaker, and wherein one or more vias in the second printed circuit board are attached to control gates that can be turned on or turned off to alter the impedance of the speaker.

* * * * *